US005857592A

United States Patent [19]

Hyldgaard et al.

[11] Patent Number: 5,857,592

[45] Date of Patent: Jan. 12, 1999

[54] DISPENSING DEVICE FOR DISPENSING LIQUID SUBSTANCE FROM A POUCH

[75] Inventors: Jorgen Gade Hyldgaard; Lars Holm Frydenlund, both of Assens, Denmark

[73] Assignee: Plum Kemi Produktion A/S, Assens, Denmark

[21] Appl. No.: 702,586

[22] PCT Filed: Mar. 1, 1995

[86] PCT No.: PCT/DK95/00093

§ 371 Date: Oct. 28, 1996

§ 102(e) Date: Oct. 28, 1996

[87] PCT Pub. No.: WO95/23546

PCT Pub. Date: Sep. 8, 1995

[30] Foreign Application Priority Data

Mar. 2, 1994 [DK] Denmark ..... 0244/94

[51] Int. Cl.[6] ..... B65D 37/00; G01F 11/28

[52] U.S. Cl. ..... 222/96; 222/103; 222/105; 222/214

[58] Field of Search ..... 222/95, 96, 103, 222/105, 107, 183, 207, 214, 490, 491, 494

[56] References Cited

U.S. PATENT DOCUMENTS

| | | | |
|---|---|---|---|
| 4,932,562 | 6/1990 | Christine | 222/96 |
| 4,974,732 | 12/1990 | Sullivan et al. . | |
| 5,016,779 | 5/1991 | Williamson | 222/95 |
| 5,018,646 | 5/1991 | Billman et al. | 222/107 |

FOREIGN PATENT DOCUMENTS

| | | |
|---|---|---|
| 226290 | 6/1987 | European Pat. Off. . |
| 329532 | 8/1989 | European Pat. Off. . |
| 433905 | 6/1991 | European Pat. Off. . |
| 8200884 | 2/1984 | Sweden . |
| WO 81/02094 | 8/1981 | WIPO . |
| WO 93/12981 | 7/1993 | WIPO . |
| WO 94/17712 | 8/1994 | WIPO . |

*Primary Examiner*—Kevin P. Shaver
*Attorney, Agent, or Firm*—Merchant, Gould, Smith, Edell, Welter & Schmidt

[57] ABSTRACT

A dispensing device is adapted to dispense metered amounts of a liquid substance from a pouch (10) made from a pair of superposed flexible sheets. The pouch defines a liquid containing chamber (15–17) and a narrow liquid discharge passage (18) communicating with the chamber at a junction position (34) and being self-sealing at that position. The device comprises liquid discharge mechanism (23, 27) for applying a pressure to the liquid substance present in the lower part of the chamber (16). The liquid discharge mechanism comprises a devices (31) for applying an inwardly directed pressure to a pouch wall closely adjacent to the junction position (34) so as to increase the angle (62) defined between the pouch wall and the plane at right angles to the longitudinal axis (13) of the discharge passage (18), whereby the discharge passage (18) may be opened. The dispensing device may also comprise a mechanism (35, 43) for bending the discharge passage (18) to an angular configuration so as to close the discharge passage when an amount of liquid has been discharged.

21 Claims, 5 Drawing Sheets

DISPENSING DEVICE FOR DISPENSING LIQUID SUBSTANCE FROM A POUCH

Figure 1:
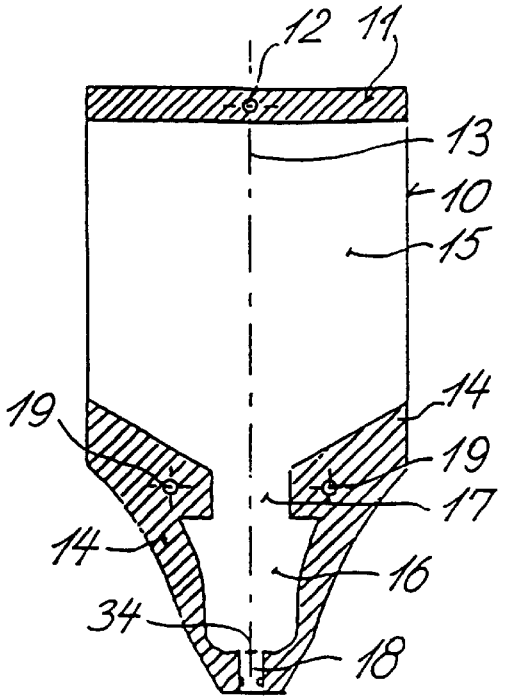

The present invention relates to a dispensing device for dispensing metered amounts of liquid substance from a pouch or bag made from a pair of superposed flexible sheets sealed together along the contour thereof so as to define between the sheets a chamber for containing the liquid substance and a narrow liquid discharge passage communicating with said chamber at a junction position and being self-sealing at that position.

Such pouches or bags may be designed such that when the liquid chamber contains a liquid substance the liquid discharge passage will be self-sealing at the junction position, vide for example Norwegian patent No. 96943.

Swedish patent application published under No. 431608 discloses a pouch or bag of the above type, especially for containing a viscous liquid product, and a dispensing device for dispensing metered portions of the liquid product therefrom. This known dispensing device comprises an actuating member which may be moved between an inactive position in which it pinches and seals the lower end of the liquid discharge passage, and an active position in which it pinches and seals a passage interconnecting a main chamber and a metering chamber of the pouch and applies a pressure to the metering chamber so as to discharge liquid product therefrom.

The international patent application published under No. WO 93/12981 discloses a pouch or bag of the above type which is adapted to contain a viscous product and which contains pumping means arranged adjacent to the discharge passage of the pouch.

The present invention provides a dispensing device of the above type which may be used for dispensing liquid products not only from pouches or bags containing viscous liquid products, but also from self-sealing pouches or bags containing liquids of relatively low viscosity, such as water, aqueous solutions, alcohol, etc.

The dispensing device according to the invention comprises means for positioning the pouch or bag containing the liquid substance so that the discharge passage is downwardly oriented, and liquid discharge means for applying the pressure to the liquid substance present in a part of the chamber adjoining the discharge passage so as to discharge an amount of liquid through said passage.

The present invention is based on the finding that when the pouch or bag filled with a liquid substance is depending freely with the discharge passage oriented downwardly the opposite sheets or walls of the passage defines (in a cross-sectional view) an obtuse angle with the central plane of the downwardly directed discharge passage and of the adjacent chamber part, and that the self-sealing effect of the pouch at said junction position is reduced when such angle is increased. Furthermore, an increase in the inner liquid pressure of the pouch tends to reduce the said angle and thereby to increase the self-sealing effect of the discharge passage.

According to a first aspect the dispensing device of the invention is characterized in the liquid discharge means comprise passage opening means including means for applying an inwardly directed pressure to one of said flexible sheets forming a chamber wall, closely adjacent to said junction position so as to increase the angle defined between said one flexible sheet and a plane at right angles to the longitudinal axis of the discharge passage and thereby to reduce or counteract the self-sealing effect of the discharge passage of the pouch. When the self-sealing effect has been reduced or counteracted by such inwardly directed pressure, liquid product may be dispensed through the discharge passage by applying a suitable pressure to the liquid substance within the pouch.

It has also been found that when the pouch or bag is made from opposite flexible sheets which are relatively stiff, the discharge passage of the pouch or bag may be opened and closed merely by transversely moving or tilting the lower part of the pouch defining the discharge passage. Therefore, according to a second aspect the dispensing device of the present invention is characterized in means for bending the opposite sheet parts, which define the discharge passage therebetween, transversely into an angular configuration, when the desired amount of liquid has been discharged. Thus the discharge passage may be opened and closed by bending the opposite sheet parts in relation to a central plane of the said chamber part between positions in which the discharge passage is substantially aligned with and out of alignment with said central plane, respectively.

When the pouch or bag is fixed to the dispensing device only at its upper end, the vertical position of the lower end of the discharge passage will inevitably change substantially when the liquid product is being dispensed from the pouch, because the pouch will become less distended as the product is being dispensed. It would, however, be advantageous to maintain the lower end of the discharge passage in substantially the same vertical position, for example to restrict the vertical movement of the lower end of the discharge passage to less than 10 mm when a pouch or bag completely filled with liquid product is being totally emptied The pouch positioning means preferably comprises suspension means for engaging with and securing portions of the pouch at a position intermediate of the upper part of the pouch and said chamber part, so that the lower part of the vouch may depend freely from the suspension means. Preferably, the suspension means are positioned above and adjacent to said chamber part.

According to a third aspect, the present invention provides a dispensing device for dispensing metered amounts of liquid substance from a pouch made from a pair of superposed flexible sheets sealed together along the contour thereof so as to define between the sheets main chamber and a smaller metering chamber for containing the liquid substances said chambers being interconnected by an interconnecting passage and a narrow liquid discharge passage communicating with the metering chamber at a junction position and being self-sealing at that position, said device comprising means for positioning the pouch containing the liquid substance so that the discharge passage is downwardly oriented, and liquid discharge means for applying a pressure to the liquid substance present in a part of the chamber adjoining the discharge passage so as to discharge an amount of liquid through said passage, the dispensing device being characterized in that the pouch positioning means comprise suspension means for engaging with and securing portions of the pouch at opposite sides of the interconnecting passage so that the lower part of the pouch may depend freely therefrom, the mutual spacing of the suspension means being so small that closing of the interconnecting passage is counteracted.

When the pouch or bag contains a viscous product which is inclined to adhere to the inner surfaces of the flexible sheets from which the pouch is made, it may be desirable to promote flow of the liquid substance from the upper part of the chamber downwardly into the lower chamber part adjacent to the discharge passage.

According no a fourth aspect of the present invention the dispensing device is characterized in means for applying an inwardly directed pressure to and/or for transversely moving the upper part of the pouch when a discharge operation has substantially been terminated. Such pressure and moving means may comprise a moveable abutment member or abutment plate engaging with one of the pouch sheets, and the pressure discharge means may be adapted to move the abutment member and the upper part of the pouch transversely when the discharge operation has been or is about to be terminated In the preferred embodiment the pressure and moving means comprise a pair of moveable, spring biased abutment members engaging with opposite sheets of the upper part of the pouch. These abutment members may, for example, be hinged at their upper end and may embrace the upper part of the pouch.

The passage opening means may further comprise means for mutually displacing the opposite sheets of the pouch in the axial direction of the discharge passage. It has been found, that such mutual displacement of the opposite sheets also tends to reduce or counteract the self-sealing effect of the pouch, probably because the mutual displacement increases the angle defined between one of the sheets and the central plane of the discharge passage as explained above.

The pouch or bag containing the liquid product may comprise a metering chamber connected to a main chamber via a interconnecting passage and arranged between the main chamber and the discharge passage In such case, the liquid discharge means may be adapted to pinch the interconnecting passage between the main chamber and the metering chamber. In the preferred embodiment, however, the discharge means are adapted to pinch the pouch or bag so as to separate a desired chamber part from the remaining part of the chamber along a pinching line and to gradually compress said chamber part from the pinching line cowards the discharge passage, whereby the liquid product contained in said chamber part is expelled therefrom through the discharge passage.

It has been found, that if the opposite sheet or wall parts of the said chamber part are pressed together so that the inner surfaces of the opposite sheet parts are pressed into intimate mutual contact when the liquid product is discharged they tend to remain adhered to each other. This means, that this chamber part is not always properly refilled by liquid product so as to be ready for discharging a further metered amount from the pouch or bag. According to the present invention the liquid discharge means are preferably adapted to compress said chamber part so as to leave the opposite sheet parts defining the chamber part therebetween in mutually closely spaced positions, which means that the inner surfaces of the opposite sheet parts do not come into contact with each other, whereby refilling of the said chamber part with liquid product is facilitated.

The dispensing device according to the invention may further comprise means for bending the opposite sheet parts defining the discharge passage therebetween transversely to the general direction of the sheet parts when a discharge operation has been terminated. It has been found that such bending of the opposite pouch wall parts defining the discharge passage may assist the self-sealing effect of the discharge passage at the junction position.

While the pouch or bag may be positioned in the dispensing device in any suitable manner which does not adversely affect the self-sealing function of the pouch, the pouch positioning means are preferably adapted to position the pouch or bag such that at least the lower part of the pouch is depending freely, whereby the positioning means does not affect the self-sealing effect of the pouch. In the preferred embodiment, the positioning means comprise suspending means for engaging with the upper part of the pouch or bag.

The pouch or bag may be of the type in which the liquid containing chamber is divided into a main chamber and a smaller metering chamber, said chambers being interconnected by a narrow interconnecting passage. In such case the positioning means may comprise means for restricting the width of the interconnecting passage so as to secure unrestricted flow of liquid substance from the main chamber into the metering chamber. When the width of the interconnecting passage is being restricted, the passage is prevented from a attaining a flat position in which the opposite passage walls are in mutual contact.

The liquid discharge means may comprise a backing member and a manually operateable pressure member mounted pivotally about a substantially horizontal pivot axis arranged about said chamber part and extending substantially parallel with the central plane of the pouch or bag, the pressure member defining a convex pouch engaging surface having a vertical cross-sectional shape substantially defining an obtuse angle. When the pressure member is operated, the vertex of the angle is first moved into contact with the pouch, whereby the opposite pouch walls are pinched between a vertex defining edge of the pressure member and the opposite backing member. At the same time, the said edge is moved upwardly, while the backing plate is substantially stationary, so that the opposite chamber walls or sheets are mutually displaced so as to assist in opening of the discharge passage of the pouch. Furthermore, the pouch engaging surface preferably comprises a substantially flat lower surface part being substantially vertical in the fully actuating position of the pressure member. This means, that the liquid substance contained in the chamber part is gradually pressed out of that chamber part by the interaction of the pouch engaging surface and the opposite surface of the backing member.

The backing member may be resiliently mounted and may also define substantially flat pouch backing surface. The resiliency of the backing member may then determine the maximum pressure being applied to the liquid product within the chamber part The dispensing device may further comprise means for temporarily pinching the discharge passage of the pouch or bag when a liquid discharge operation has been terminated. Thereby the opposite sheet parts or wall parts defining the discharge passage may be pressed into mutual contact, so as to avoid undesirable dripping of liquid product from the discharge passage after termination of the discharge operation.

In a preferred embodiment, the discharge passage pinching means comprise a raised part or ridge formed at the lower end at the pouch engaging and/or backing surfaces.

Figure 2:
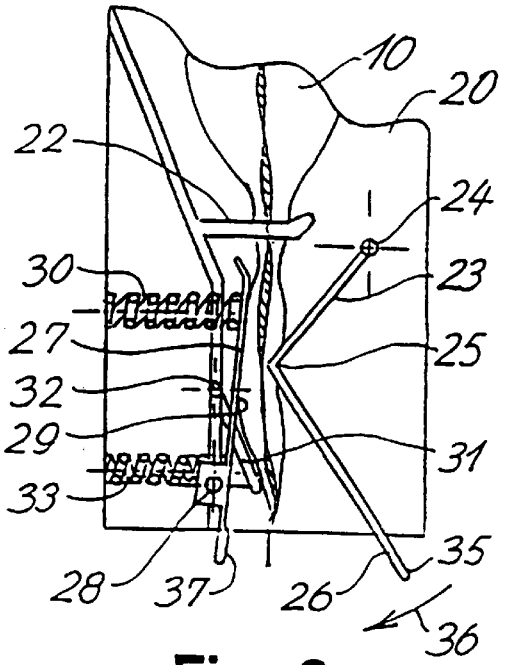
Figure 3:
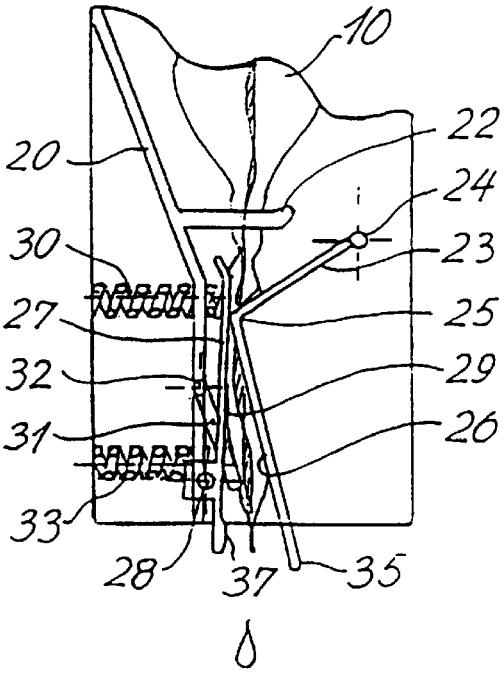
Figure 4:
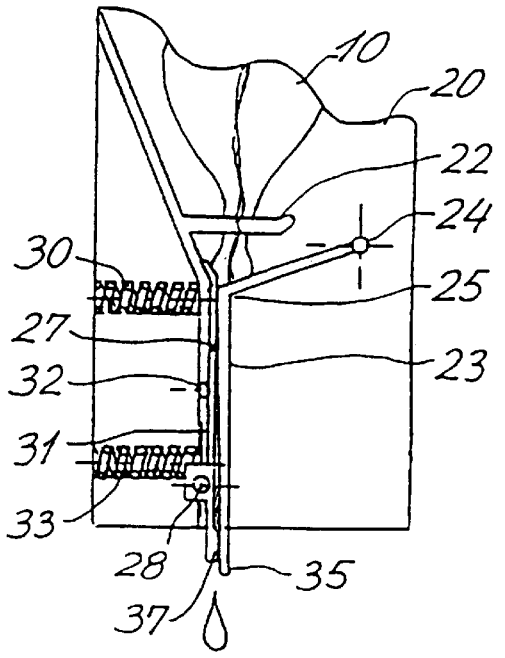
Figure 5:
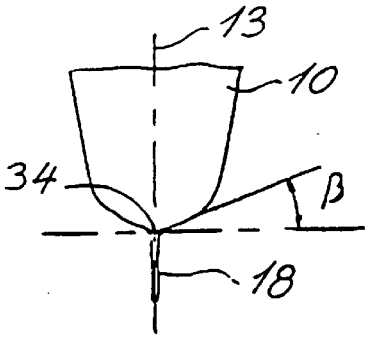
Figure 6:
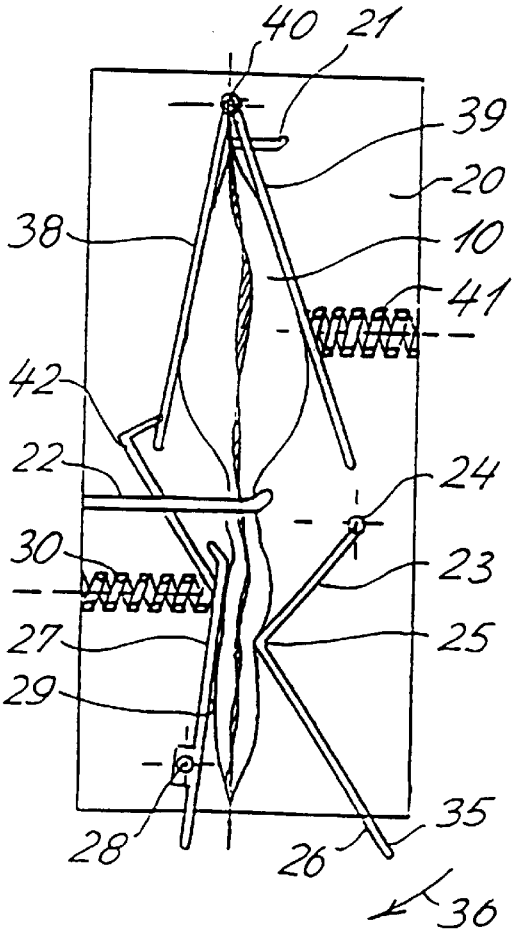
Figure 7:
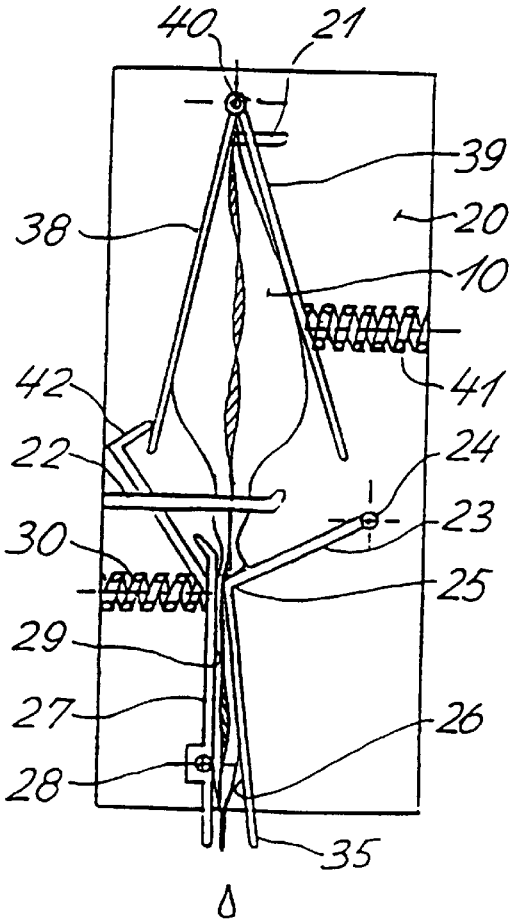
Figure 8:
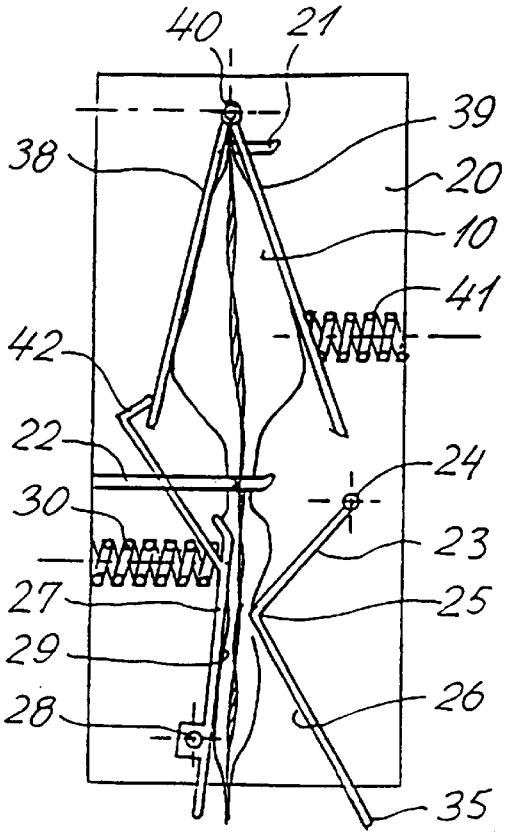
Figure 9:
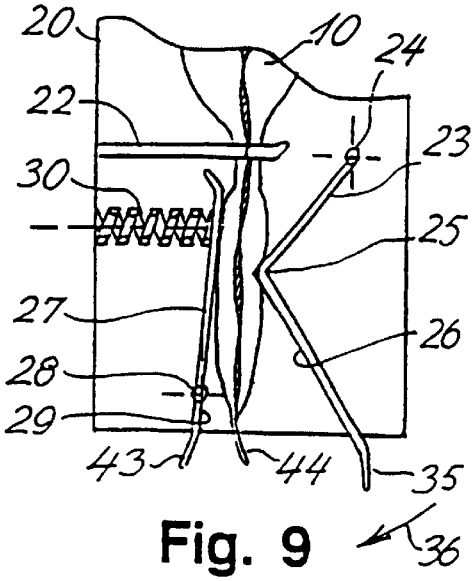
Figure 11:
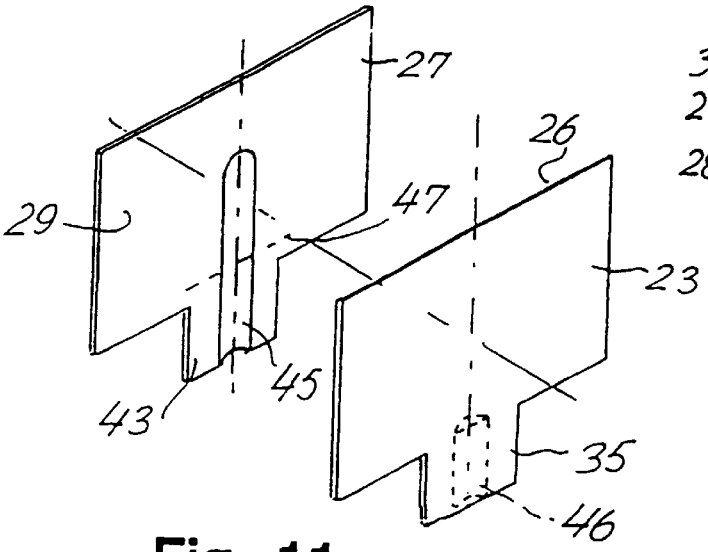
Figure 10:
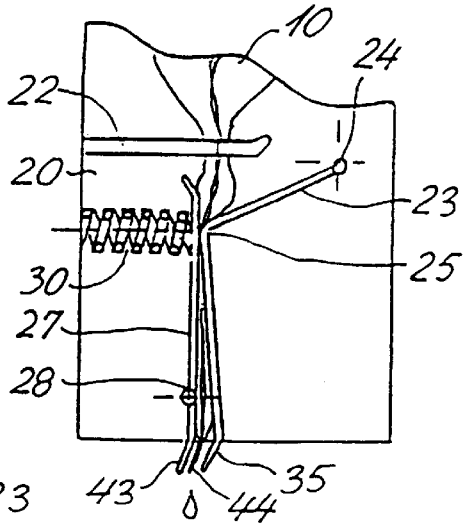
Figure 12:
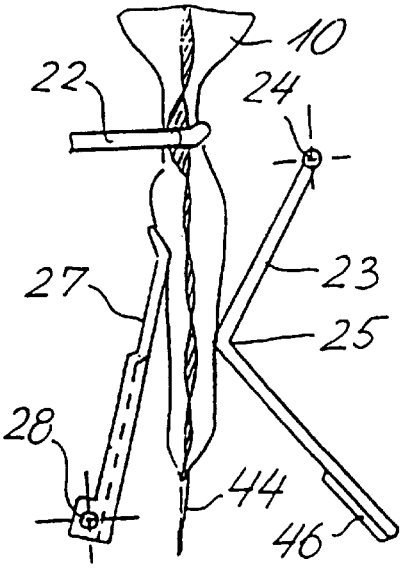
Figure 13:
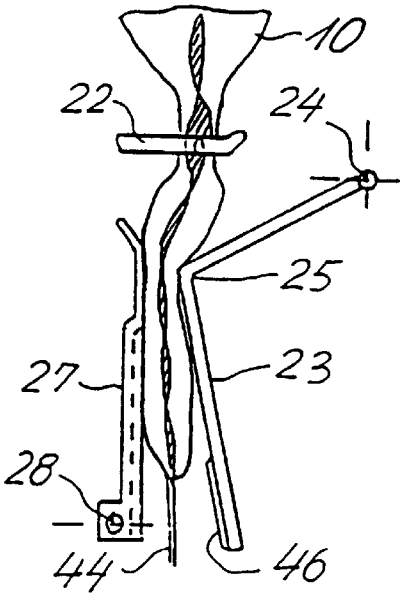
Figure 14:
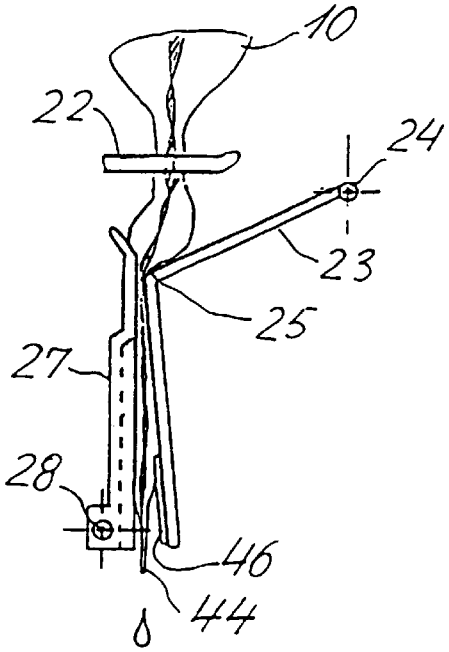
Figure 15:
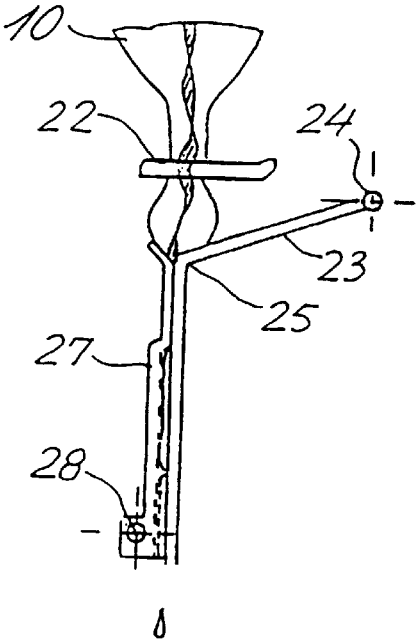
Figure 16:
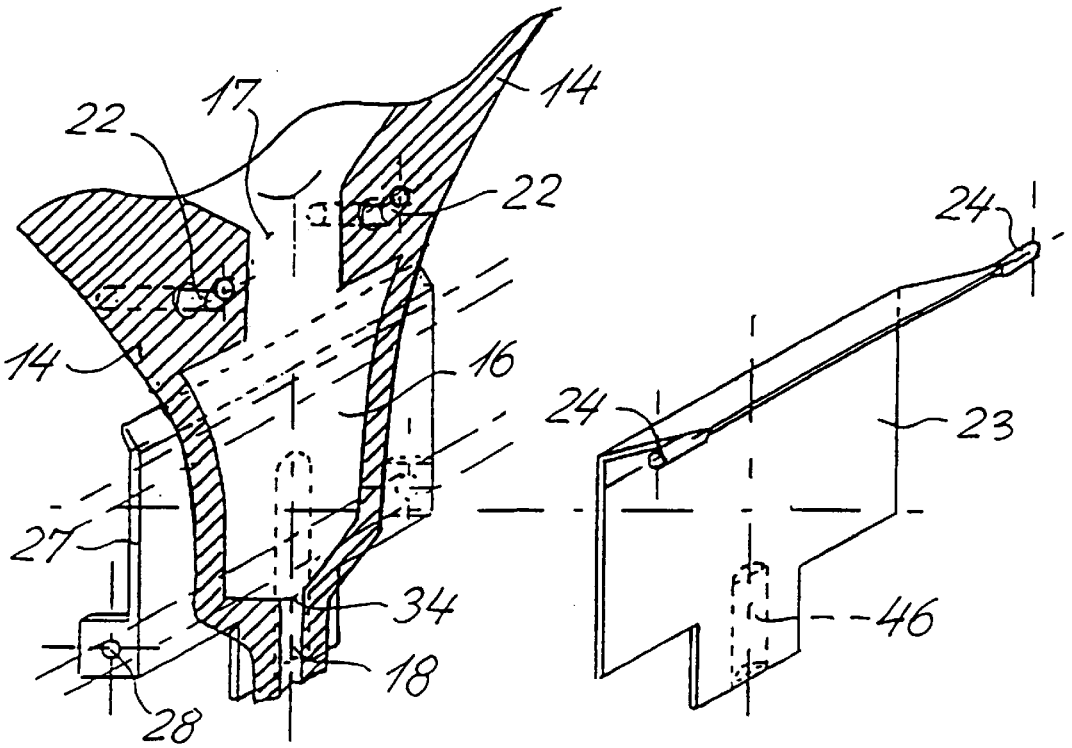

The invention will now be further described with reference to the drawings, wherein FIG. 1 is a plan view of an empty pouch or bag of the type used in connection with the dispensing device according to the invention, FIGS. 2–4 are side views of the lower part of a first embodiment of the dispensing device with a filled pouch mounted therein, the dispensing device being shown in different operational positions, FIG. 5 is a diagrammatic side view of the lower part of a freely depending pouch filled with a liquid product, FIGS. 6–8 are side views of a second embodiment of the dispensing device shown in different operational positions, FIGS. 9 and 10 are side views of the lower part of a third embodiment of the dispensing device according to the invention shown in two different operational positions, FIG. 11 is a perspective view of pressure and backing plates which may be used in connection with the dispensing device according to the invention, FIGS. 12–15 are diagrammatic side views showing cooperating pressure and backing plates of a fourth embodiment of the dispensing device according to the invention, and FIG. 16 is a perspective view showing cooperating pressure and backing plates and the lower end of a pouch made therebetween.

FIG. 1 shows the a pouch or bag 10 which is made from a pair of oppositely arranged plastic films, which are sealingly interconnected along the contour of the pouch. The pouch 10 has an upper marginal heat sealed area 11 having formed therein an upper suspension opening 12 positioned on a central symmetry axis 13 of the pouch. A pair of lower oppositely arranged heat sealed areas 14, which interconnect the opposite plastic films, are shaped so as to divide the inner space of the pouch into an upper main chamber 15 and a lower smaller chamber 16. The chambers 15 and 16 are interconnected by an interconnecting passage 17, and the lower chamber 16 communicates with a downwardly directed discharge passage 18. A pair of lower suspension openings 19 are formed in the lower heat sealed areas 14 and are positioned irediately above the smaller chamber 16 on either side of the symmetry axis 13.

The pouch or bag 10 may be filled with a more or less viscous liquid product, and the plastic film or sheet material from which the pouch is made may, for example, be a 150 $\mu$ polyethylene film or a laminate of polyethylene and polyester.

FIGS. 2–4 illustrate a dispensing device for dispensing metered amounts of liquid product from a pouch 10 of the type shown in FIG. 1. The dispensing device comprises a frame or housing 20 having an upper suspension pin or hook 21 (vide FIGS. 6–8) not shown in FIGS. 2–4, and a pair of lower suspension pins or hooks 22. When a filled pouch or bag 10 is arranged in the dispensing device the upper suspension pin or hook 21 is passed through the upper suspension opening 12 and the lower suspension pins or hooks 22 are passed through the lower suspension openings 19 of the pouch or bag. In the embodiment shown in FIGS. 2–4, the liquid discharge means of the dispensing device comprise a manually operateable pressure member 23 which is pivotally mounted about a substantially horizontal pivot axis 24 extending substantially parallel with the central plane of the pouch 1o suspended in the dispensing device. Such central plane is substantially defined by the heat sealed areas 11 and 14. The profile of the pressure member 23 viewed in the direction of the pivot axis 24 defines an obtuse angle having a vertex or edge 25 and a Free lower end part defining a substantially flat pressure surface 26. The liquid discharge means further comprise a backing member 27 mounted pivotally about a pivot axis 28, and the backing member 27, which defines a backing surface 29 facing the pressure surface 26, is biased in a direction towards the pressure member 23 by a spring 30. The lower end of the pouch or bag 10, which includes the lower chamber 16 and the discharge passage is, depends freely from the lower pins 22 and is positioned between the pressure member 23 and the backing member 27. A passage opening member 31 is mounted on the frame or housing 20 pivotally about a pivot axis 32. The passage opening member 31 is biassed in a direction towards the pressure member 23 by a spring 33. The lower free end of the passage opening member 31 is positioned such that it may be moved into contact with the adjacent pouch wall at a position vertically above, but closely adjacent to a junction point or junction position 34 between the chamber 16 and the discharge passage 18, vide FIG. 1.

The dispensing device according to the present invention is used in connection with pouches or bags of the self-sealing type. This means that when the pouch 10 contains a liquid product and is suspended with the discharge passage 18 oriented downwardly the stresses created in the flexible sheets or films forming the chamber walls cause the discharge passage 18 to seal automatically FIG. 5 diagrammatically illustrates the lower part of a pouch or bag 10, which contains a liquid product and which is distended under the influence of the weight of the liquid. It has been found that the self-sealing effect is dependent on the angle defined between the lower shoulder at the pouch at the junction position 34, and a line extending at right angles to the central axis 13. Thus, the self-sealing effect is increased when the angle $\beta$ is decreased This means that the sealing effect at the junction position 34 may be counteracted by applying a pressure to the pouch walls adjacent to the junction position 34 so as to increase the angle $\beta$. The operation of the dispensing device shown in FIGS. 2–4 will now be described FIG. 2 shows the dispensing device in a resting position. A metered amount of liquid product may be dispensed from the pouch 10 by manually pushing the lower free end 35 in the direction indicated by an arrow 36 in FIG. 2. The edge 25 of the pressure member 23 will thereby be moved into engagement with the adjacent side wall of the lower chamber 16 so as to pinch the opposite pouch walls between the edge 25 and the opposite backing surface 29 (FIG. 3) so as to separate an amount of liquid product from the liquid product in the upper part of the pouch 10. Simultaneously, the lower free end of the passage opening member is moved into engagement with the adjacent wall part of the pouch adjacent to the junction position 34, whereby the angle $\beta$ (FIG. 5) is increased so as to counteract the self-sealing effect. Furthermore, the edge 25 of the pressure member 23 tends to move the adjacent plastic film or sheet upwardly in relation to the opposite film or sheet. Such mutual vertical displacement of the opposite plastic films or sheets also tends to reduce the self-sealing effect of the discharge passage 18. When the pressure member 23 is moved from the position shown in FIG. 3 to the position shown in FIG. 4 the separated liquid amount is pressed out through the discharge passage 18. The forces of the springs 30 and 31 determine the maximum pressure applied to the lower part of the pouch 10 by the pressure and backing members 23 and 27 and by the passage opening member 31, respectively.

The pressure surface 26 of the pressure member 23 and the backing surface 29 of the backing member 27 are preferably shaped such that the adjacent inner surfaces of the opposite film or sheet portions, which are engaged by the pressure and backing surfaces 26 and 29, are not pressed into intimate contact with each other, but remain closely spaced when the discharge operation has been terminated. However, the lower rim portion of the backing surface 29 defines a raised part or a ridge 37 cooperating with the pressure surface 26 so as to pinch the discharge passage 18 when the pressure member 26 has been fully actuated and moved to the position shown in FIG. 4. Thereby undesired dripping of liquid product from the discharge passage 18 may be avoided after termination of the discharge operation. The mutual distance between the lower pins 22 may be somewhat smaller than the mutual distance between the lower suspension openings 19 of the pouch 10, whereby unobstructed flow of liquid product from the main chamber 15 into the lower chamber 16 through the interconnecting passage 17 may be secured.

FIGS. 6–8 show a modified embodiment of the dispensing device described above with reference to FIGS. 2–4. In the embodiment shown in FIGS. 6–8 the upper part of the pouch 10 is embraced by a pair of plate members 38 and 39 pivotally mounted at their upper ends about a pivot axis 40, which extends substantially parallel with the pivot axes 24 and 28 and which is positioned above and adjacent to the upper suspension pin 21. The plate member 39 is biased in a direction towards the pouch 10 by a spring 41, and an extension member 42 forming part of the backing member 29 is kept in contact with the outer surface of the plate member 38 under the bias of the spring 30. In the resting position illustrated in FIG. 7, the pressure of the spring 30 is balanced by the pressure of the spring 41.

The discharge means of the dispensing device shown in FIGS. 6–8 operates in substantially the same manner as described above in connection with FIGS. 2–4. In FIGS. 6–8 the passage opening member 31 has been left out It should be understood, however, that such passage opening member could advantageously be included also in the embodiment shown in FIGS. 6–8. When the lower free end 35 of the pressure member 23 is moved manually in the direction indicated by the arrow 36 from the position shown in FIG. 6 to the position shown in FIG. 7 a metered liquid portion is discharged through the discharge passage 18 as described above. Such movement of the pressure member 23 causes the backing member 27 and its extension member 42 to move counterclockwise. The counterclockwise movement of the extension member 42 allows the spring 41 to move the plate member 39, the upper part of the pouch 10, and the plate member 38 clockwise to the position shown in FIG. 7. When a metered amount of liquid product has been discharged, the pressure member 23 is released, and the backing member 27, its extension member 42, the plate members 38 and 39, and the upper part of the pouch 10 arranged therebetween are suddenly moved from the position shown in FIG. 7 to the position shown in FIG. 8 under the bias of the spring 30. This transverse movement of the upper part of the pouch 10 and the sudden additional pressure applied to the pouch 10 by the spring biased plate members 38 and 39 cause liquid product to flow from the upper part of the pouch 10 and to refill the lower part of the pouch from which a metered amount of liquid product was dispensed during the preceding discharge operation.

FIGS. 9 and 10 illustrate a modified embodiment of the discharge means shown in FIGS. 6–8. In the embodiment illustrated in FIGS. 9 and 10 the lower free end of the pressure member 23 and the backing member 27, respectively, define an angle with the pressure surface 26 and the backing surface 29, respectively.

When the pressure member 23 has been fully actuated and the discharge operation is about to be terminated, the free ends 35 and 43 of the pressure member 23 and the backing member 27, respectively, comes into contact with the lower pouch part 44 defining the liquid discharge passage 18, whereby this lower part 44 is bent out of alignment with the central plane of the pouch at the end of the discharge operation. Especially when the pouch is made from relatively stiff plastic films such bending causes an efficient sealing of the discharge passage 18.

FIG. 11 illustrates more in detail how the cooperating pressure and backing surfaces 26 and 27 may be shaped. As shown in FIG. 11 the backing plate 27 may define a groove 45 therein for receiving the lower part 44 of the pouch 10, and a complementary shaped raised part 46 may be formed on the pressure surface 26. When the pressure member 23 has been fully actuated, the opposite inner walls of the discharge passage 18 is pressed into close contact by the raised part 46 and the lower end 44 is bent along a line 47 indicated in FIG. 11. However, the pouch walls received in the groove 45 above the line 47 is pressed into a position in which they are closely spaced, but not in mutual contact.

FIGS. 12–16 illustrate an embodiment which has been slightly modified compared to the embodiment shown in FIGS. 2–4. Thus, in the embodiment of FIG. 12–16 the lower part 44 of the pouch 10 is not bend out of alignment with the central plane of the pouch 10 at the end of a discharge operation. However, as best shown in FIG. 16 the lower part 44 is received in an axial groove having a cross-sectional shape defining an arc of a circle. In other respects the embodiment shown in FIGS. 12–16 operate in substantially the same manner as the embodiment shown in FIGS. 2–4 or in FIGS. 9–11.

should be understood, that various amendments and changes of the embodiments described above with reference to the drawings could be made within the scope of the present invention. As an example, plate members 38 and 39 or similar members could be used in connection with any of the embodiments described above and shown in the drawings. Similarly, a passage opening member 31 could be combined with any of the embodiments shown and described.

We claim:

1. A dispensing device for dispensing metered amounts of liquid substance from a pouch made from a pair of superposed flexible sheets sealed together along the contour thereof so as to define between the sheets a chamber for containing the liquid substance and a narrow liquid discharge passage communicating with said chamber at a junction position and being selfsealing at that position, said device comprising means for positioning the pouch containing the liquid substance so that the discharge passage is downwardly oriented, and liquid discharge means for applying a pressure to the liquid substance present in a part of the chamber adjoining the discharge passage so as to discharge an amount of liquid through said passage, the the liquid discharge means comprising passage opening means including means for applying an inwardly directed pressure to one of said flexible sheets forming a chamber wall, closely adjacent to said junction position so as to increase an angle defined between said one flexible sheet and a plane at right angles to the longitudinal axis of the discharge passage.

2. A dispensing device for dispensing metered amounts of liquid substance from a pouch made from a pair of superposed flexible sheets sealed together along the contour thereof so as to device between the sheets a chamber for containing the liquid substance and a narrow liquid discharge passage communicating with said chamber at a junction position, said device comprising means for positioning the pouch containing the liquid substance so that the discharge passage is downwardly oriented, liquid discharge means for applying a pressure to the liquid substance present in a part of the chamber adjoining the discharge passage so as to discharge an amount of liquid through said passage, and means for bending the opposite sheet parts, which define the discharge passage there between, transversely into an angular configuration, when the desired amount of liquid has been discharged.

3. A dispensing device according to claim 2, further comprising means for bending the opposite sheet parts defining the discharge passage there between transversely to the general direction of the sheet parts when a discharge operation has been terminated.

4. A dispensing device according to claim 2, wherein the pouch positioning means are adapted to position the pouch such that at least the lower part of the pouch is depending freely.

5. A dispensing device according to claim 2, wherein the pouch is of the type in which the liquid containing chamber is divided into a main chamber and a smaller metering chamber, said chambers being interconnected by a narrow interconnecting passage, said positioning means comprising means for restricting the width of the interconnecting passage so as to ensure unrestricted flow of liquid substance form the main chamber into the metering chamber.

6. A dispensing device according to claim 2, wherein the liquid discharge means are adapted to pinch the pouch so as to separate said chamber part from the remaining part of the chamber along a pinching line and to gradually compress said chamber part from the pinching line towards the discharge passage.

7. A dispensing device according to claim 6, wherein the liquid discharge means are adapted to compress said chamber part so as to leave the opposite sheet parts defining the chamber part there between in mutually closely spaced positions.

8. A dispensing device according to claim 2, further comprising means for temporarily pinching the discharge passage of the pouch when a liquid discharge operation has been terminated.

9. A dispensing device according to claim 8, wherein the discharge passage pinching means comprise a raised part or ridge formed at the lower end of the pouch engaging and/or backing surfaces.

10. A dispensing device according to claim 2, wherein the liquid discharge means comprise a backing member and a manually operateable pressure member mounted pivotally about a substantially horizontal pivot axis arranged above said chamber part and extending substantially parallel with the central plane of the pouch, the pressure member defining a convex pouch engaging surface having a vertical cross-sectional shape substantially defining an obtuse angle.

11. A dispensing device according to claim 10, wherein the pouch engaging surface comprises a substantially flat lower surface part being substantially vertical in the fully actuated position of the pressure member.

12. A dispensing device according to claim 11, wherein the backing member is resiliently mounted and defines a substantially flat pouch backing surface.

13. A dispensing device according to claim 12, wherein the backing member is mounted such that the backing surface is substantially vertical in the fully actuated position of the pressure member.

14. A dispensing device according to claim 12, wherein opposite parts of the pouch engaging and backing surfaces are transversely spaced in the fully actuated condition of the liquid discharge means.

15. A dispensing device for dispensing metered amounts of liquid substance from a pouch made from a pair of superposed flexible sheets sealed together along the contour thereof so as to define between the sheets a main chamber and a smaller metering chamber for containing the liquid substance, said chambers being interconnected by an interconnecting passage, and a narrow liquid discharge passage communicating with the metering chamber at a junction position and being self-sealing at that position, said device comprising means for positioning the pouch continuing the liquid substance so that the discharge passage is downwardly oriented, and liquid discharge means for applying a pressure to the liquid substance present in a part of the chamber adjoining the discharge passage so as to discharge an amount of liquid through said passage, the pouch positioning means comprising suspension means for engaging with and securing portions of the pouch at opposite sides of the interconnecting passage so that the lower part of the pouch may depend freely therefrom, the mutual spacing of the suspension means being so small that closing of the interconnecting passage is counteracted.

16. A dispensing device according to claim 15, wherein the liquid discharge means comprise passage opening means including means for applying an inwardly directed pressure to one of the flexible forming a chamber wall, closely adjacent to said junction position.

17. A dispensing device according to claim 16, wherein the passage opening means further comprise means for mutually displacing the opposite sheets in an axial direction of the discharge passage.

18. A dispensing device according to claim 16, wherein the passage opening means comprises a spring biased lever having a free end portion for applying an pressure to a pouch chamber wall adjacent to the junction position when the liquid discharge means are being actuated.

19. A dispensing device for dispensing metered amounts of liquid substance from a pouch made from a pair of superposed flexible sheets sealed together along the contour thereof so as to define between the sheets a chamber for containing a liquid substance, and a narrow liquid discharge passage communicating with said chamber at a junction position, said device comprising means for positioning the pouch continuing the liquid substance so that the discharge passage is downwardly oriented, liquid discharge means for applying a pressure to the liquid substance present in a part of the chamber adjoining the discharge passage so as to discharge an amount of liquid through said passage, and means for applying an inwardly directed pressure to and/or for transversely moving the upper part of the pouch when a discharge operation has substantially been terminated.

20. A dispensing device according to claim 19, wherein the pressure and moving means comprise a movable abutment member engaging with one of the pouch sheets, the pressure discharge means being adapted to move the abutment member and the upper part of the pouch transversely at the end of discharge operation.

21. A dispensing device according to claim 20, wherein the pressure and moving means comprise a pair of moveable, spring biased abutment member engaging with opposite sheets of the upper part of the pouch.

* * * * *